US006393746B1

(12) United States Patent
Jacobson

(10) Patent No.: US 6,393,746 B1
(45) Date of Patent: May 28, 2002

(54) TRUCK-SIDE DISPLAY FRAMING SYSTEM

(76) Inventor: Todd Jacobson, 4609 Skimmer Way, St. Petersburg, FL (US) 33711

( * ) Notice: Subject to any disclaimer, the term of this patent is extended or adjusted under 35 U.S.C. 154(b) by 0 days.

(21) Appl. No.: 09/514,712

(22) Filed: Feb. 28, 2000

Related U.S. Application Data

(60) Provisional application No. 60/122,413, filed on Mar. 2, 1999.

(51) Int. Cl.[7] ..... G09F 21/04
(52) U.S. Cl. ..... 40/590; 40/603; 160/378
(58) Field of Search ..... 40/590, 591, 603, 40/604; 160/378

(56) References Cited

U.S. PATENT DOCUMENTS

| | | | | | |
|---|---|---|---|---|---|
| 4,580,361 | A | * | 4/1986 | Hillstrom et al. | 40/603 |
| 4,922,988 | A | * | 5/1990 | Loomis | 160/368.1 |
| 5,046,545 | A | * | 9/1991 | Loomis et al. | 40/603 |
| 5,239,765 | A | * | 8/1993 | Opdahl | 40/603 |
| 5,373,653 | A | * | 12/1994 | Suzuki | 40/603 |
| 5,507,109 | A | * | 4/1996 | Rinzler | 40/603 |
| 6,041,535 | A | * | 3/2000 | Holloway et al. | 40/603 |
| 6,167,649 | B1 | * | 1/2001 | Palmeri | 40/603 |
| 6,250,002 | B1 | * | 6/2001 | Wittenberg | 40/603 |

* cited by examiner

*Primary Examiner*—Jack Lavinder
*Assistant Examiner*—William L. Miller

(74) *Attorney, Agent, or Firm*—Fowler White Boggs Banker, P.A.; Dennis L. Cook, Esq.

(57) ABSTRACT

A flexible vinyl display framing system that provides for a top railing running from front to back across the uppermost part of trailer, which is a C-channel extrusion. A front railing running from top to bottom down the forward most support beam of the trailer, which is a C-channel extrusion. A bottom railing running across the entire bottom of the trailer, which is an L-angle extrusion. A back railing running from top to bottom down the back most support rail, which is also an L-angle extrusion. And, a custom tensioning extrusion, which has a C-channel opening on the top and a straight channel across the bottom. The straight channel has a slot running the length of the channel in which bolts are inserted allowing for attachment to the L-angle extrusions. The system is deployed in the following manner. A flexible vinyl display is pocketed on all four edges with spleen or spline cord sewn into each pocket to create a stiffened, rounded edge. The top and front stiffened edges of the flexible vinyl display are then pulled through the top and front railing C-channel extrusions. Once the flexible vinyl display is hanging from the top and front railings, the custom tensioning extrusions, with bolts inserted, are slid piece by piece on the back and bottom stiffened edges of the flexible vinyl display. The bolts then attach the custom tensioning extrusions to the L-angle extrusions of the back and bottom railings. Once the bolts are engaged the tensioning process begins by tightening each of the bolts pulling the custom tensioning extrusions to as close to the L-angle extrusions as possible, creating a tight pull on all four sides.

4 Claims, 5 Drawing Sheets

TRUCK-SIDE DISPLAY FRAMING SYSTEM

CROSS-REFERENCE TO RELATED APPLICATION

The present application claims the benefit of previously filed co-pending Provisional Patent Application, Ser. No. 60/122,413, filed Mar. 2, 1999.

FIELD OF THE INVENTION

The present invention is an improvement in display framing systems and, more specifically, is an apparatus that can be used to easily mount and tighten flexible displays on the sides of large vehicles

BACKGROUND OF THE INVENTION

There are many mobile advertising display systems in the marketplace that claim easy installation and proper flexible display tensioning. While most of them have some merit and offer some benefits, they all can be generally categorized by their limitations.

Some displays are fabricated by simply painting the advertisement directly on the surface of the vehicle, or by applying sign panels to the surface using adhesives, or by applying an adhesive film containing an advertisement. These displays are expensive, difficult to install, and difficult to change in a timely fashion. In addition, their useful life is limited by constant exposure to the elements.

Rigid signs, or signs with protective covers, have also been used and they provide more protection from the elements and improved changability, but are cumbersome and often very heavy.

A number of improved displays using tensioned panels have been proposed which are adapted to use on mobile surfaces. These systems offer the ability to change the display in a more timely and efficient manner, while the ability to roll up the panel for easy storage or transport helps reduce environmental wear and prolong the display's useful life. However, complex and costly tensioning frames are typically required in order to tension the fabric panel. For example, U.S. Pat. No. 4,580,361 discloses a tensioning frame, which employs edge rails with integral spring tensioners to apply tension to the periphery of an advertising panel. Besides being complex and prone to mechanical failure after prolonged environmental exposure, these edge rails protrude significantly from the mounting surface and may be unusable in some tractor trailer applications because of width restrictions.

U.S. Pat. No. 5,239,765 discloses another type of tensioned panel display, which uses an elastic panel tensioned between top, and bottom stays, which are held in place by two rows of anchors. While this offers an improvement over the more complex mounting frame described above, it suffers from several disadvantages arising from the use of an elastic panel in a rigid mounting. It requires a complex mounting procedure and extensive adjustments in order to achieve and maintain the proper tensioning of the panel. Multiple anchors must be aligned to achieve uniform tension across the panel and minimize wrinkling and flutter. Stretching, due to the frame flexible inherent in large trailers, necessitates frequent readjustment of the stays and anchors. A further disadvantage is that there is nothing, beyond the tension on the panel itself, to prevent the impinging air stream from getting under the leading edge of the panel, causing flutter, damage or dislocation.

U.S. Pat. No. 5,507,109 discloses a mobile advertising display that can be used to display a desired visual message along the lateral surface of a mobile vehicle, such as a truck, van or trailer. It includes a display panel that can be attached to tracks on the lateral surface of the vehicle. The display panel is suspended at the desired tension with a hook and cord assembly. Retaining rods keep the top and leading edges of the display panel connected to the tracks. This hook and cord assembly is still a cumbersome method of tensioning the display.

It would be advantageous if a mobile advertising display using a tensioned panel could be devised, which provides for quick and easy installation, and has an easily adjustable tensioning means.

It is therefore an object of this invention to disclose a truck-side display framing system that offers the ability to change the display in a timely and efficient manner. It is a further object of this invention to supply a system that is simple and has an easily adjustable tensioning means.

SUMMARY OF THE INVENTION

The present invention has been made to solve the problems described above. The display framing system of the present invention provides for a top railing running from front to back across the uppermost part of trailer. This top railing is a C-channel extrusion, and serves as an anchor support for tensioning from top to bottom. A front railing running from top to bottom down the forward most support beam of the trailer, which is a C-channel extrusion. This railing is also used as an anchor for tensioning from front to back. A bottom railing running across the entire bottom of the trailer, which is an L-angle extrusion. This extrusion is used as an anchor for the custom tensioning extrusion. A back railing running from top to bottom down the back most support rail, which is also an L-angle extrusion. This extrusion is also used as an anchor for the custom tensioning extrusion. And, a custom tensioning extrusion, which has a C-channel opening on the top and a straight channel across the bottom. The straight channel has a slot running the length of the channel in which carriage bolts are inserted allowing for attachment to the L-angle extrusions. The shoulders of the carriage bolts slide through the channel in the custom tensioning extrusion so that no turning of the carriage bolts is allowed and tightening nuts can be twisted on the carriage bolts.

The system is deployed in the following manner: a flexible vinyl display is pocketed on all four edges with spleen or spline cord sewn into each pocket to create a stiffened, rounded edge. The top and front stiffened edges of the flexible vinyl display are then pulled through the top and front railing C-channel extrusions. Once the flexible vinyl display is hanging from the top and front railings, the custom tensioning extrusions, with carriage bolts inserted, are slid piece by piece on the back and bottom stiffened edges of the flexible vinyl display. The carriage bolts then attach the custom tensioning extrusions to the L-angle anchors of the back and bottom railings. Once the carriage bolts are engaged the tensioning process begins by tightening a nut on each of the carriage bolts pulling the custom tensioning extrusions to as close to the L-angle anchor extrusions as possible, creating a tight pull on all four sides.

BRIEF DESCRIPTION OF THE DRAWINGS

Other objects, features, and advantages of the present invention will become apparent from the detailed description of the invention, which follows, when considered in light of the accompanying drawings in which.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
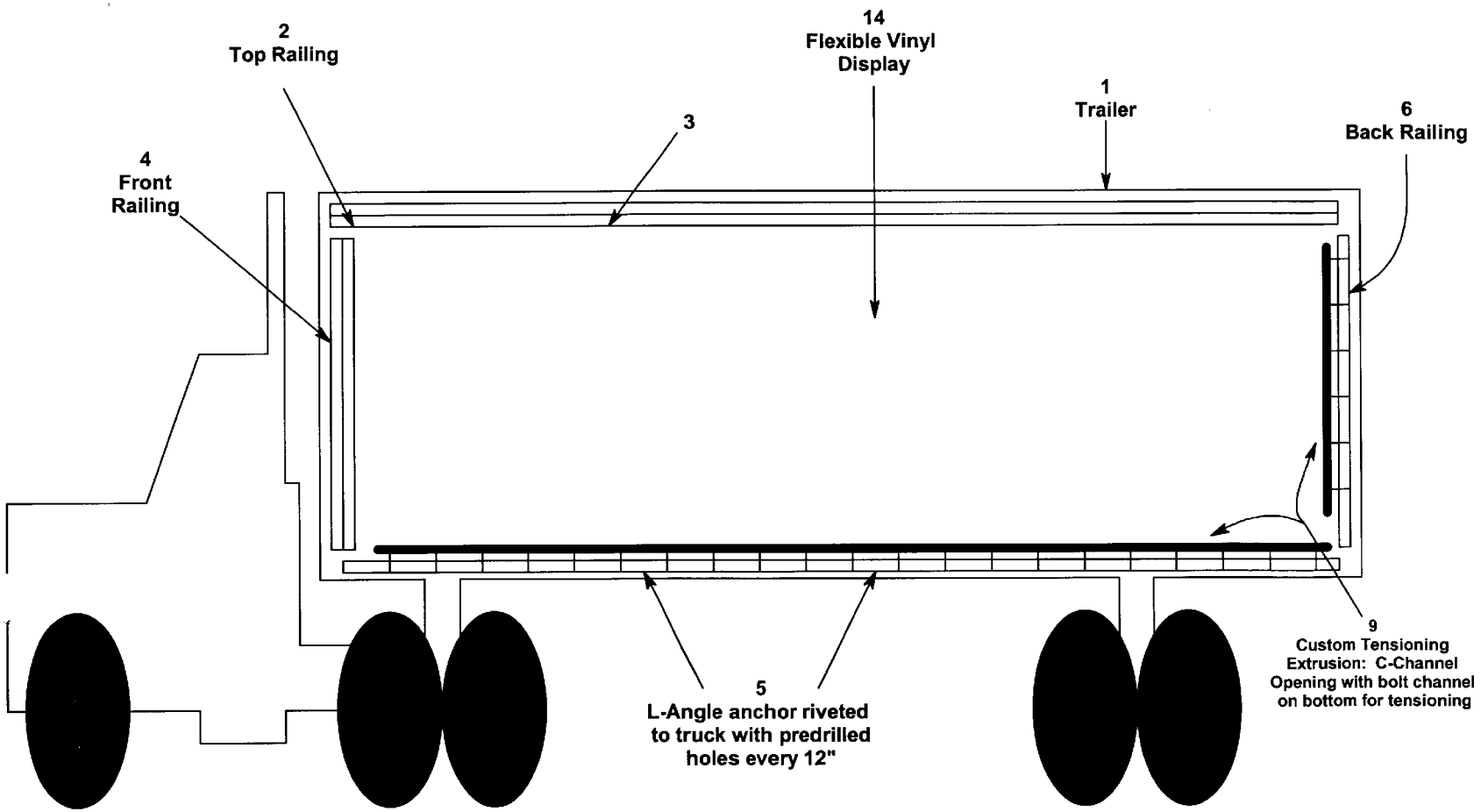
FIG. 1 is a diagram showing the assembled Truck-side Display Framing System
Figure 3:
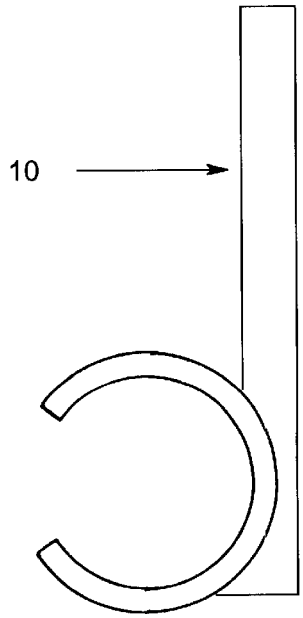
FIG. 3 is a blown-up diagram of the C-channel Extrusion.

Referring now to the drawings, FIG. 1 is a schematic representation of the preferred embodiment of the Truck-Side Display Framing System for mounting on the side of large vehicles consisting of a Top Railing (2) running from front to back across the uppermost part of Trailer (1) which is an Aluminum C-channel Extrusion (10) shown more completely in FIG. 3. It is installed with any of a variety of Trailer Rivets (3), which are well known to those skilled in the art. These Trailer Rivets (3) are bolted through support beams (not shown), or in case of rfp fiberglass sides, every 12 inches. This Top Railing (2) could also be installed using structural bonding tape by methods well known in the art. This Top Railing (2) is used as an anchor support for tensioning from top to bottom.

Figure 2:
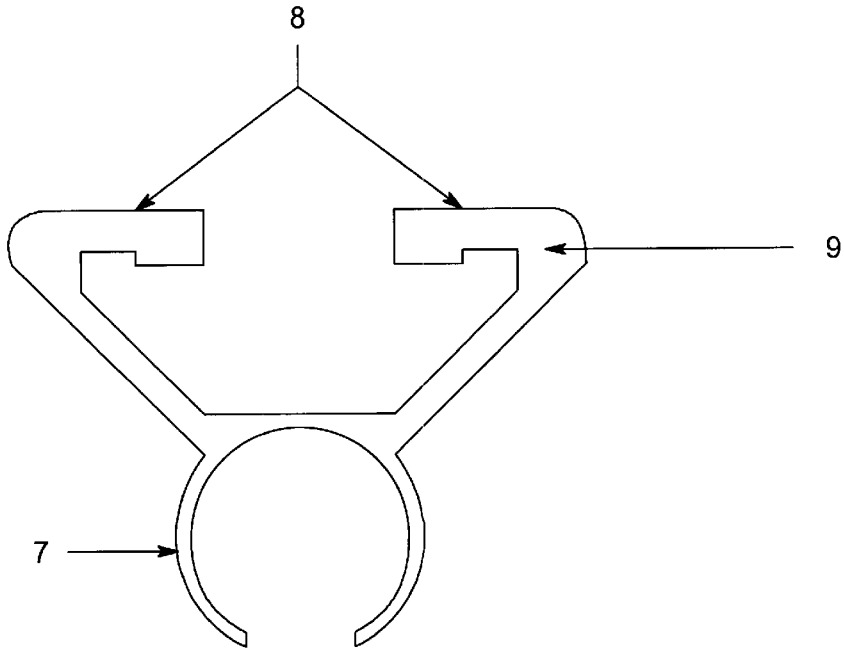
FIG. 2 is a blown-up diagram of the Custom Tensioning Extrusion.

A Front Railing (4) running from top to bottom down the forward most support beam (not shown) of the Trailer (1), or in case of rfp fiberglass top to bottom on the forward most part of Trailer (1). This Front Railing (4) is also an Aluminum C-channel Extrusion (10) as shown in FIG. 2. This Front Railing (4) is also installed using Trailer Rivets (3) or structural bonding tape. This Front Railing (4) is used as an anchor for tensioning from front to back.

Figure 4:
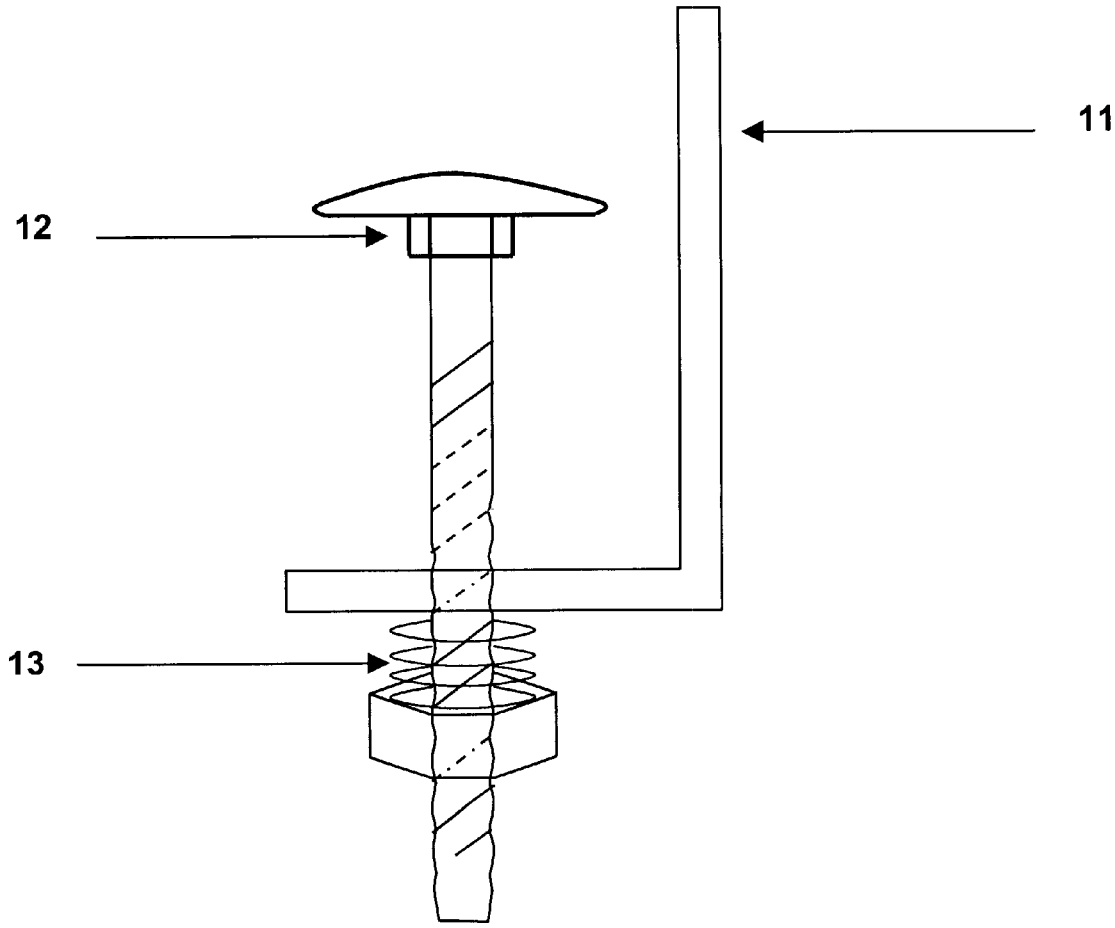
FIG. 4 is a blown-up diagram of the L-angle Extrusion.

A Bottom Railing (5) running across the entire bottom of the Trailer (1) which is an Aluminum L-angle Extrusion (11) as shown in more detail in FIG. 4. It is installed using Trailer Rivets (3) into each of the support beams (not shown), or in the case of rfp fiberglass, riveted every 12 inches. The Bottom Railing can also be installed using structural bonding tape. The Aluminum L-angle Extrusion (11) has holes periodically spaced along the protruding lip to allow the Carriage Bolts (12) (a type of bolt commonly known to those skilled in the art) used for tensioning to be threaded through and extend beyond the holes. This Bottom Railing (5) is used as an anchor for the Aluminum Custom Tensioning Extrusion (9) shown in FIG. 2.

A Back Railing (6) running from top to bottom down the back most support beam (not shown) which is an Aluminum L-angle Extrusion (11). It is also installed using Trailer Rivets (3) or structural bonding tape. The Aluminum L-angle Extrusion (11) has holes periodically spaced along the protruding lip to allow the Bolts (12) used for tensioning to be threaded through and extend beyond the holes. This Back Railing (6) is used as an anchor for the Aluminum Custom Tensioning Extrusion (9).

FIG. 2 discloses the Aluminum Custom Tensioning Extrusion (9) that has a C-channel Opening (7) extending lengthwise extending end to end on the top, and a Straight Channel (8) extending lengthwise from end to end on the bottom.

Figure 6:
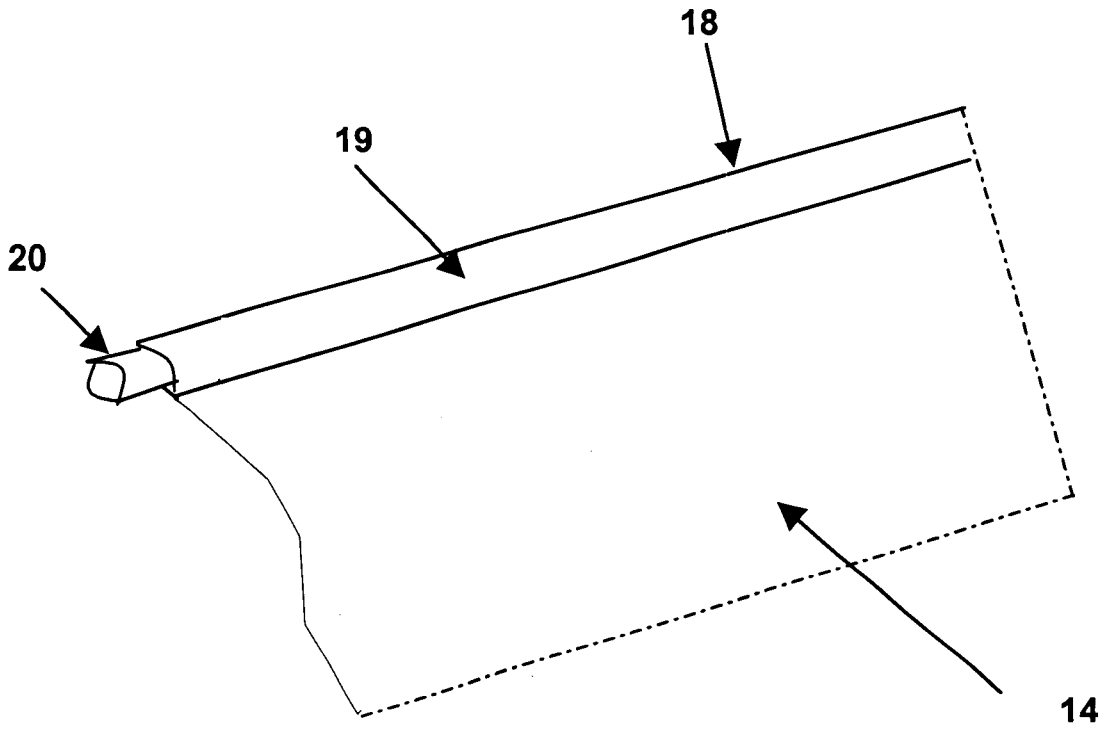
FIG. 6 is a cut away diagram of the flexible vinyl display.

The system is deployed as follows:

The Flexible Vinyl Display (14), which will be suspended on the framing system, has stiffened, rounded edges (18) on all four edges as more clearly shown in FIG. 6. These stiffened, rounded edges (18) should be of sufficient size to be threaded into the C-channels of the Aluminum Custom Tensioning Extrusion (9) and Aluminum C-channel Extrusion (10) without pulling out of the opening of the channel. In the preferred embodiment these stiffened, rounded edges (18) are created by sewing pockets (19) on all four edges of the flexible vinyl display (14) with spleen or spline cord (20) (a type of cord commonly known to those skilled in the art) sewn into each pocket (19) creating a stiffened, rounded edge (18). Any other means of creating stiffened, rounded edges, which are well known in the art, will work with this system. These stiffened, rounded edges (18) are then threaded into, and pulled through the full length of the Aluminum C-channel Extrusions (10) of the Top Railing (2) and Front Railing (4).

Once the Flexible Vinyl Display (14) is hanging from the Top Railing (2) and Front Railing (4), the Aluminum Custom Tensioning Extrusions (9) are slid on the backside edge and bottom edge of the Flexible Vinyl Display (14). Carriage Bolts (12) are then inserted in the channel of the Aluminum Custom Tensioning Extrusions (9). These Aluminum Custom Tensioning Extrusions (9) are then attached to the Back Railing (6) and Bottom Railing (5) Aluminum L-angle Extrusions (11) approximately every twelve inches by the Carriage Bolts (12), which are inserted in, and hang from, the slots in the Aluminum Custom Tensioning Extrusion (9). The shoulders of the Carriage Bolts (12) slide through the channel in the Custom Tensioning Extrusion (9) such that no twisting of the Carriage Bolts (12) is allowed. The Carriage Bolts (12) are then threaded through the holes in the Aluminum L-angle Extrusion (11) and nuts are placed on each of the Carriage Bolts (12). The tensioning process begins by tightening a nut threaded on each of the Carriage Bolts (12) (hanging from the Aluminum Custom Tensioning Extrusion (9)) pulling the Aluminum Custom Tensioning Extrusions (9) to as close to the Back Railing (6) and Bottom Railing (5) as possible, creating a tight pull on all four sides. Springs (13) can be added on the Carriage Bolts (12) between the Aluminum L-angle Extrusions (11) and the Carriage Bolt (12) tightening nut to aid in holding the Flexible Vinyl Display (14) taught if the Flexible Vinyl Display (14) should expand or shrink due to weather conditions.

Figure 5:
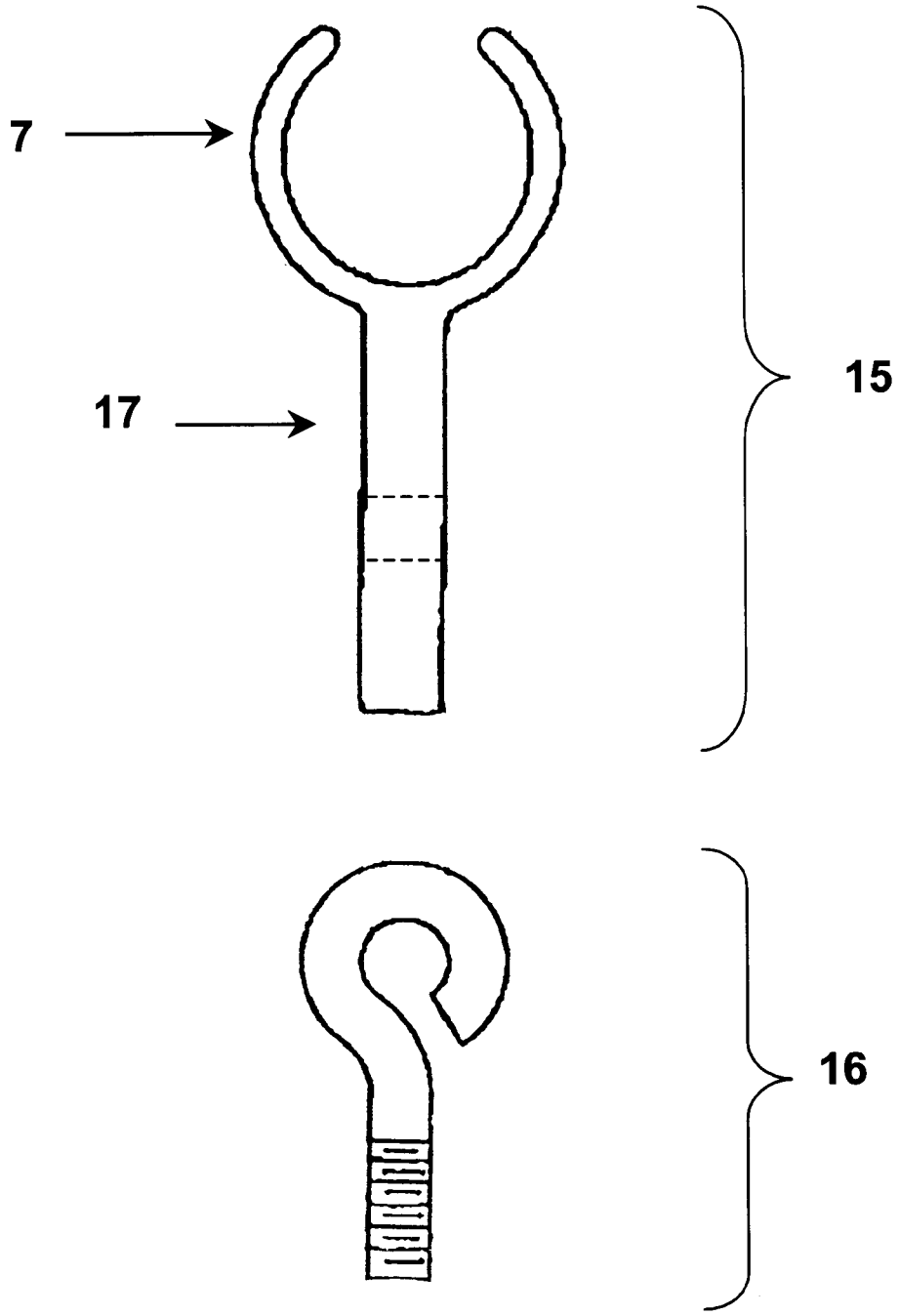
FIG. 5 is a blown-up diagram of a Modified Custom Tensioning Extrusion and Eyebolt.

FIG. 5 shows a Modified Custom Tensioning Extrusion (15) and an Eyebolt (16) used in situations where a minimum projection of the Truck-Side Display Framing System from the side of the Trailer (1) is required. The Modified Custom Tensioning Extrusion (15) has the same C-Channel Opening (7) as the Custom Tensioning Extrusion (9), but rather than having a Straight Channel (8) extending lengthwise from end to end on the bottom there is instead a Flat Connection Extension (17) extending from and protruding outward from the back center of the C-Channel Opening (7). This Flat Connection Extension (17) has holes drilled through it perpendicular to the axis of the C-Channel Opening (7) such that the eye of an Eyebolt (16) can be inserted in the hole. The Eyebolt (16) then hangs and projects downward from the end of the Flat Connection Extension (17). This embodiment is then deployed in the same manner with the Modified Custom Tensioning Extrusion (15) replacing the Custom Tensioning Extrusion (9) and the Eyebolts (16) replacing the Carriage Bolts (12).

In another alternative embodiment to be used on the back rather than the side of a Trailer (1) the Front Railing (4) and Back Railing (6) are not used and the Flexible Vinyl Display (14) is tensioned as described above only from top to bottom between the Top Railing (2) and Bottom Railing (5).

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims.

That which is claimed is:

1. A Flexible Vinyl Display Framing System which can be attached to the side of a large vehicle consisting of:

a top railing,
- said top railing being a first C-channel extrusion having a circular channel with an opening extending the length of said top railing,
- said top railing attachable horizontally across the upper part of the side of a large vehicle such that said first C-channel extrusion protrudes from the side of a large vehicle, a front railing,
- said front railing being a second C-channel extrusion having a circular channel with an opening extending the length of said front railing,
- said front railing attachable vertically along a forward part of the side of a large vehicle such that said second C-channel extrusion protrudes from the side of a large vehicle, a bottom railing,
- said bottom railing being a first L-angle extrusion,
- said bottom railing attachable horizontally across the bottom part of the side of a large vehicle such that one lip of said first L-angle extrusion protrudes from the side of a large vehicle,
  - said lip having periodically spaced holes, a back railing,
- said back railing being a second L-angle extrusion,
- said back railing attachable vertically along a back part of the side of a large vehicle such that one lip of said second L-angle extrusion protrudes from the side of a large vehicle,
  - said lip of said second L-angle extrusion having periodically spaced holes, a flexible vinyl display,
- said flexible vinyl display having a front, stiffened, rounded edge,
  - said front stiffened, rounded edge being of such diameter that said front stiffened, rounded edge fits within the circular channel of said first C-channel extrusion but will not pull through the opening in the circular channel of said first C-channel extrusion,
  - said front stiffened, rounded edge being inserted into said first C-channel extrusion of said front railing,
- said flexible vinyl display having a top, stiffened, rounded edge,
  - said top stiffened, rounded edge being of such diameter that said top stiffened, rounded edge fits within the circular channel of said second C-channel extrusion but will not pull through the opening in the circular channel of said second C-channel extrusion,
  - said top stiffened, rounded edge being inserted into said second C-channel extrusion of said top railing, a custom tensioning extrusion,
- said custom tensioning extrusion being the same length as the length of said flexible vinyl display,
- said custom tensioning extrusion having a C-channel top opening and a straight bottom channel,
  - said bottom channel having a slot extending the length of said bottom channel,
    - said slot containing tensioning bolts such that the head of said tensioning bolts fits snugly inside said bottom channel and the threaded part of said tensioning bolts extends out said slot of said bottom channel
  - said flexible vinyl display having a backside stiffened, rounded edge,
    - said backside stiffened, rounded edge being of such diameter that said backside stiffened, rounded edge fits within the circular channel of said C-channel top opening of said custom tensioning extrusion but will not pull through the opening in the circular channel of said C-channel top opening of said custom tensioning extrusion,
  - said C-channel top opening of said custom tensioning extrusion being slid on said backside stiffened, rounded edge of said flexible vinyl display, a second custom tensioning extrusion,
- said second custom tensioning extrusion being the same length as the height of said flexible vinyl display,
- said second custom tensioning extrusion having a C-channel top opening and a straight bottom channel,
  - said bottom channel having a slot extending the length of said bottom channel,
    - said slot containing tensioning bolts such that the head of said tensioning bolts fits snugly inside said bottom channel and the threaded part of said tensioning bolts extend out said slot of said bottom channel,
  - said flexible vinyl display having a bottom stiffened, rounded edge,
    - said bottom stiffened, rounded edge being of such diameter that said bottom stiffened, rounded edge fits within the circular channel of said C-channel top opening of said second custom tensioning extrusion but will not pull through the opening in the circular channel of said C-channel top opening of said second custom tensioning extrusion,
  - said C-channel top opening of said second custom tensioning extrusion being slid on said bottom stiffened, rounded edge of said flexible vinyl display,
    - said custom tensioning extrusion attached to said backside stiffened, rounded edge then being attached to said back railing by inserting said tensioning bolts into said holes in said protruding lip of said first L-angle extrusion and attaching tightening nuts to said tensioning bolts,
    - said second custom tensioning extrusion that was attached to said bottom stiffened, rounded edge then being attached to said bottom railing by inserting said tensioning bolts into said holes in said protruding lip of said second L-angle extrusion and attaching said tightening nuts to said tensioning bolts; and, tightening said flexible vinyl display by tightening said bolts using said tightening nuts thereby pulling said custom tensioning extrusion as close to said back railing and said bottom railing as possible, creating a tight pull on said flexible vinyl display.

2. The Flexible Vinyl Display Framing System of claim 1 further comprising:

springs, said springs being placed over the threaded end of said tensioning bolts such that said springs are positioned between said first L-angle extrusion and said tightening nuts threaded on said tensioning bolts; and, said springs also being placed over the threaded end of said tensioning bolts such that said springs are positioned between said second L-angle extrusion and said tightening nuts threaded on said tensioning bolts.

3. A Flexible Vinyl Display Framing System which can be attached to the back of a large vehicle consisting of:

a top railing, said top railing being a C-channel extrusion having a circular channel with an opening extending the length of said top railing, said top railing attachable horizontally across the upper part of the back of a large vehicle such that said C-channel extrusion protrudes from the back of a large vehicle, a bottom railing, said bottom railing being a L-angle extrusion, said bottom railing attachable horizontally across the bottom part of the back of a large vehicle such that one lip of said L-angle extrusion protrudes from the back of large vehicle, said lip having periodically spaced holes, a flexible vinyl display, said flexible vinyl display having a top, stiffened, rounded edge, said top stiffened, rounded edge being of such diameter that said top stiffened, rounded edge fits within the circular channel of said C-channel extrusion but will not pull through the opening in the circular channel of said C-channel extrusion, said top stiffened, rounded edge being inserted into said C-channel extrusion of said top railing, a custom tensioning extrusion, said custom tensioning extrusion being the same length as the length of said flexible vinyl display, said custom tensioning extrusion having a C-channel top opening and a straight bottom channel, said bottom channel having a slot extending the length of said bottom channel, said slot containing tensioning bolts such that the head of said tensioning bolts fits snugly inside said bottom channel and the threaded end of said tensioning bolts extend out said slot of said bottom channel, said flexible vinyl display having a bottom stiffened, rounded edge, said bottom stiffened, rounded edge being of such diameter that said bottom stiffened, rounded edge fits within the circular channel of said C-channel top opening of said custom tensioning extrusion but will not pull through the opening in the circular channel of said C-channel top opening of said custom tensioning extrusion, said C-channel top opening of said custom tensioning extrusion being slid on said bottom stiffened, rounded edge of said flexible vinyl display, said custom tensioning extrusion that was attached to said bottom stiffened, rounded edge then being attached to said bottom railing by inserting said tensioning bolts into said holes in said protruding lip of said L-angle extrusion and attaching tightening nuts to said tensioning bolts; and tightening said flexible vinyl display by tightening said tensioning bolts using said tightening nuts thereby pulling said custom tensioning extrusion as close to said bottom rail as possible, creating a tight pull on said flexible vinyl display.

4. The Display Framing System of claim 3 further comprising:

springs; and, said springs being placed over the threaded end of said tensioning bolts such that said springs are positioned between said L-angle extrusion and said tightening nuts threaded on said tensioning bolts.

* * * * *